US005975446A

United States Patent [19]

Yaguchi et al.

[11] Patent Number: 5,975,446

[45] Date of Patent: *Nov. 2, 1999

[54] PULVERIZING APPARATUS

[75] Inventors: Hiroshi Yaguchi; Masami Tomita, both of Numazu; Yasuo Asahina, Yokohama; Hiroyuki Fushimi, Numazu; Satoru Miyamoto, Mishima; Tomomi Suzuki, Gotenba, all of Japan

[73] Assignee: Ricoh Company, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/769,411

[22] Filed: Dec. 19, 1996

[30] Foreign Application Priority Data

| | | | |
|---|---|---|---|
| Dec. 22, 1995 | [JP] | Japan | 7-350317 |
| Aug. 27, 1996 | [JP] | Japan | 8-244320 |
| Dec. 18, 1996 | [JP] | Japan | 8-350122 |

[51] Int. Cl.[6] ..... B02C 19/00

[52] U.S. Cl. ..... 241/76; 241/135; 241/152.2

[58] Field of Search ..... 241/152.2, 29, 241/134, 135, 76, 80, 97

[56] References Cited

U.S. PATENT DOCUMENTS

| | | | |
|---|---|---|---|
| 5,221,051 | 6/1993 | Hashimoto et al. | 241/152.2 |
| 5,297,743 | 3/1994 | Tadema | 241/152.2 |

FOREIGN PATENT DOCUMENTS

| | | | |
|---|---|---|---|
| 3323517 | 1/1985 | Germany | 241/152.2 |
| 3504584 | 8/1986 | Germany | 241/152.2 |

*Primary Examiner*—Mark Rosenbaum
*Attorney, Agent, or Firm*—Cooper & Dunham LLP

[57] ABSTRACT

An apparatus for pulverizing solid particles including an impact-type pulverizing device, a mechanical-type pulverizing device and a piping system connected to the pulverizing devices such that the solid particles may be selectively pulverized in the impact-type pulverizing device and in the mechanical-type pulverizing device successively in this or reverse order.

4 Claims, 2 Drawing Sheets

PULVERIZING APPARATUS

BACKGROUND OF THE INVENTION

1. Field of the Invention

This invention relates to a pulverizing apparatus for the production of a powder material such as toner for use in electrophotography or electrostatic recording.

2. Description of Prior Art

JP-A-7-181,736 discloses an apparatus for pulverizing a raw toner material into a toner product having a small particle size and a good fluidity, including a high impact-type pulverizing device having inlet and outlet ports, and a low impact-type pulverizing device connected to the outlet port of the high impact-type pulverizing device, such that the raw toner material is successively pulverized in the high and low impact-type pulverizing devices in this order.

The known pulverizing apparatus has a problem because of lack of versatility. For example, with the known apparatus, it is difficult to obtain a toner product having a narrow particle size distribution.

SUMMARY OF THE INVENTION

It is, therefore, an object of the present invention to provide a pulverizing apparatus which is versatile and has excellent production efficiency.

In accomplishing the above object, there is provided in accordance with the present invention an apparatus for pulverizing solid particles, comprising:

a first pulverizing zone including an impact-type pulverizing device;

first inlet conduit means connected to said first pulverizing zone for feeding said solid particles thereto, first outlet conduit means connected to said first pulverizing zone, so that said solid particles fed to said first pulverizing zone through said first inlet conduit means are pulverized by said impact-type pulverizing device and then discharged from said first pulverizing zone through said first outlet conduit means;

a second pulverizing zone including a mechanical-type pulverizing device;

second inlet conduit means connected to said second pulverizing zone for feeding said solid particles thereto;

second outlet conduit means connected to said second pulverizing zone, so that said solid particles fed to said second pulverizing zone through said second inlet conduit means are pulverized by said mechanical-type pulverizing device and then discharged from said second pulverizing zone through said second outlet conduit means;

means for selectively introducing said solid particles into either one of said first and second inlet conduit means;

first transferring conduit means extending between said first pulverizing zone and said second pulverizing zone for introducing said solid particles pulverized in said impact-type pulverizing device into said second pulverizing zone;

second transferring conduit means extending between said second pulverizing zone and said first pulverizing zone for introducing said solid particles pulverized in said mechanical-type pulverizing device into said first pulverizing zone;

first means provided in said first outlet conduit means and said first transferring conduit means for selectively introducing said solid particles pulverized in said impact-type pulverizing device into either one of said first outlet conduit means and said first transferring conduit means; and second means provided in said second outlet conduit means and said second transferring conduit means for selectively introducing said solid particles pulverized in said mechanical-type pulverizing device into either one of said second outlet conduit means and said second transferring conduit means, whereby said solid particles may be successively pulverized in said impact-type pulverizing device and in said mechanical-type pulverizing device in this or reverse order.

BRIEF DESCRIPTION OF THE DRAWINGS

Other objects, features and advantages of the present invention will become apparent from the detailed description of the preferred embodiments of the invention which follows, when considered in light of the accompanying drawings, in which.

DETAILED DESCRIPTION OF THE PREFERRED EMBODIMENTS OF THE INVENTION

Figure 1:
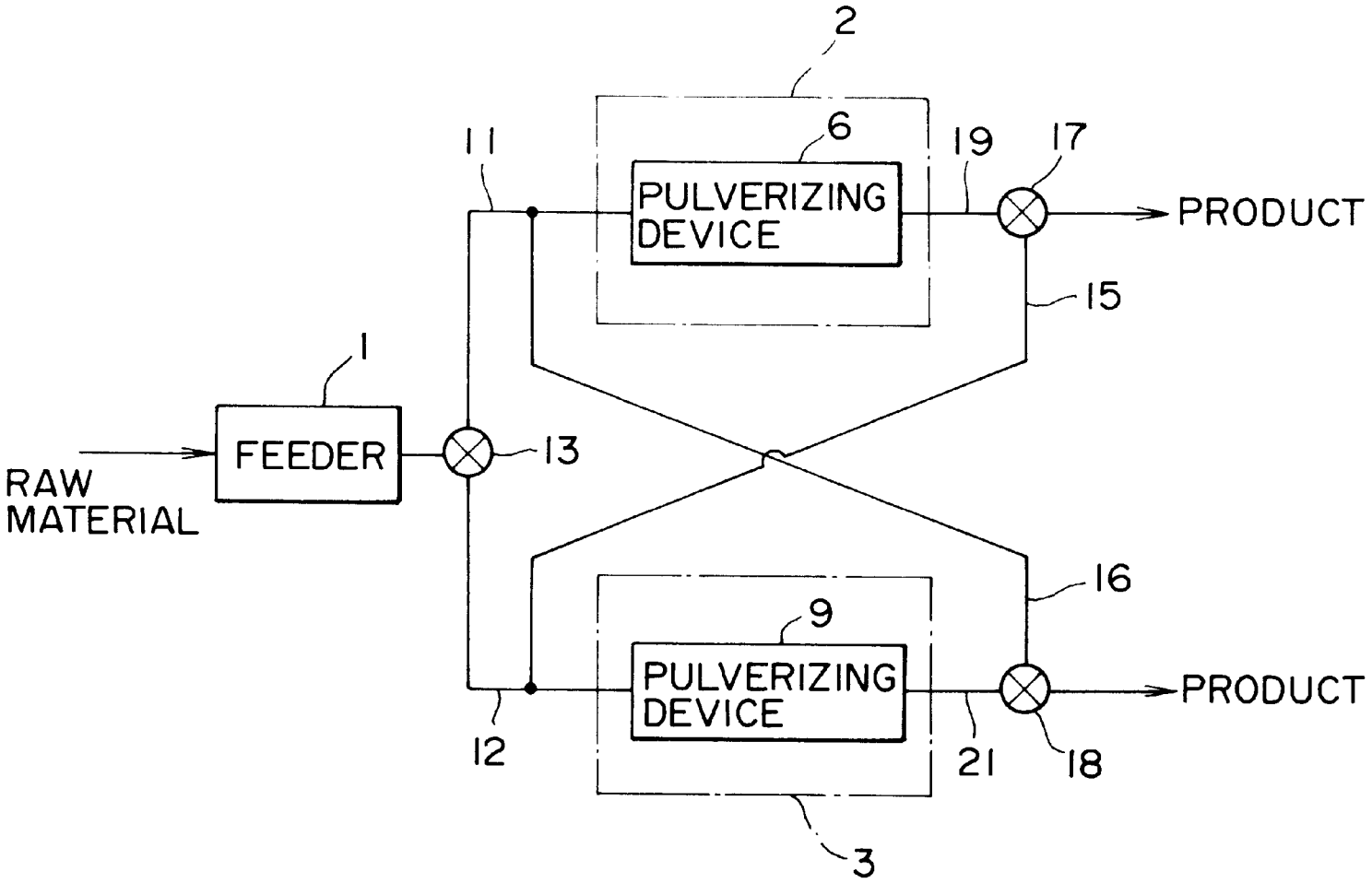
FIG. 1 is a flow diagram schematically illustrating one embodiment of a pulverizing apparatus according to the present invention.

Referring to FIG. 1, designated generally as 2 and 3 are first and second pulverizing zones, respectively. The first pulverizing zone 2 includes an impact-type pulverizing device 6, a first inlet conduit 11 connected to the pulverizing device 6 for feeding solid particles to be pulverized thereto, and a first outlet conduit 19 connected to the pulverizing device 6. Thus, the solid particles fed to the first pulverizing zone 2 through the first inlet conduit 11 are pulverized by the impact-type pulverizing device 6 and then discharged from the first pulverizing zone 2 through the first outlet conduit 19.

Similarly, the second pulverizing zone 3 includes a mechanical-type pulverizing device 9, a second inlet conduit 12 connected to the pulverizing device 9 for feeding solid particles to be pulverized thereto, and a second outlet conduit 21 connected to the pulverizing device S. Thus, the solid particles fed to the second pulverizing zone 3 through the second inlet conduit 12 are pulverized by the mechanical-type pulverizing device 9 and then discharged from the second pulverizing zone 3 through the second outlet conduit 21.

The impact-type pulverizing device 6 is of a type in which the pulverization of solid particles is effected by an impact force directly applied by an operating member of the device to the solid particles and which is suited to form a pulverized product having a particle size of 10 $\mu$m at less. Illustrative of suitable impact-type pulverizing devices are a hammer mill, a roll crusher, a ball mill, a tube mill, a vibration mill and a jet impacting mill. Above all, the use of a super sonic jet impacting mill having a stationary collision plate against which solid particles carried by compressed air are collided at a high speed is preferred. Such a jet impacting is commercially available under a trade name of retype or IDS-type collision Plate Mill from Japan Pneumatic Industry Co., Ltd.

The mechanical-type pulverizing device 9, on the other hand, is of a type which can rotate or spin the solid particles and which is suited to form a pulverized product having a particle size of 10–500 μm. Illustrative of suitable mechanical-type pulverizing device 9 are a cage mill, a pin mill and a rotor-type mill. Above all, the use of a rotor-type mill composed of a stationary cylindrical vessel and a rotor coaxiially disposed within the vessel with a fine annular gap being defined between the rotor and the inside periphery of the vessel is preferred. Such a rotor-type mill is commercially available under a trade name of Turbo Mill (manufactured by Turbo Zndustry Co., Ltd.), Kryptron (manufactured by Kawasaki Heavy Industry Co., Ltd.) or Fine Mill (Japan Pneumatic Industry Co., Ltd.).

Designated as 1 is a raw material feeder connected to the first and second pulverizing zones 2 and 3 through the inlet conduits 11 and 12 and a valve 13 so that the raw material solid particles may be selectively introduced into desired one of the first and second pulverizing zones 2 and 3 by the operation of the valve 13, The raw material feeder is preferably an injection feeder operable to feed a predetermined amount of the solid particles using a jet flow of compressed air.

A first transferring conduit 15 extends between the first pulverizing zone 2 and the second pulverizing zone 3 for introducing the solid particles pulverized in the impact-type pulverizing device 6 into the second pulverizing zone 3. Also a second transferring conduit 16 extends between the second pulverizing zone 3 and the first pulverizing zone 2 for introducing the solid particles pulverized in the techanical-type pulverizing device 9 into the first pulverizing zone 2.

In the illustrated embodiment, the first transferring conduit 15 in connected to a first valve 17 disposed in the first outlet conduit 19, while the second transferring conduit 16 is connected to a second valve 18 disposed in the second outlet conduit 21. Thus, by selectively setting the positions of the valves 13, 17 and 18, the solid particles may be successively pulverized in the impact-type pulverizing device 6 and in the mechanical-type pulverizing device 9 in this or reverse order.

Figure 2:
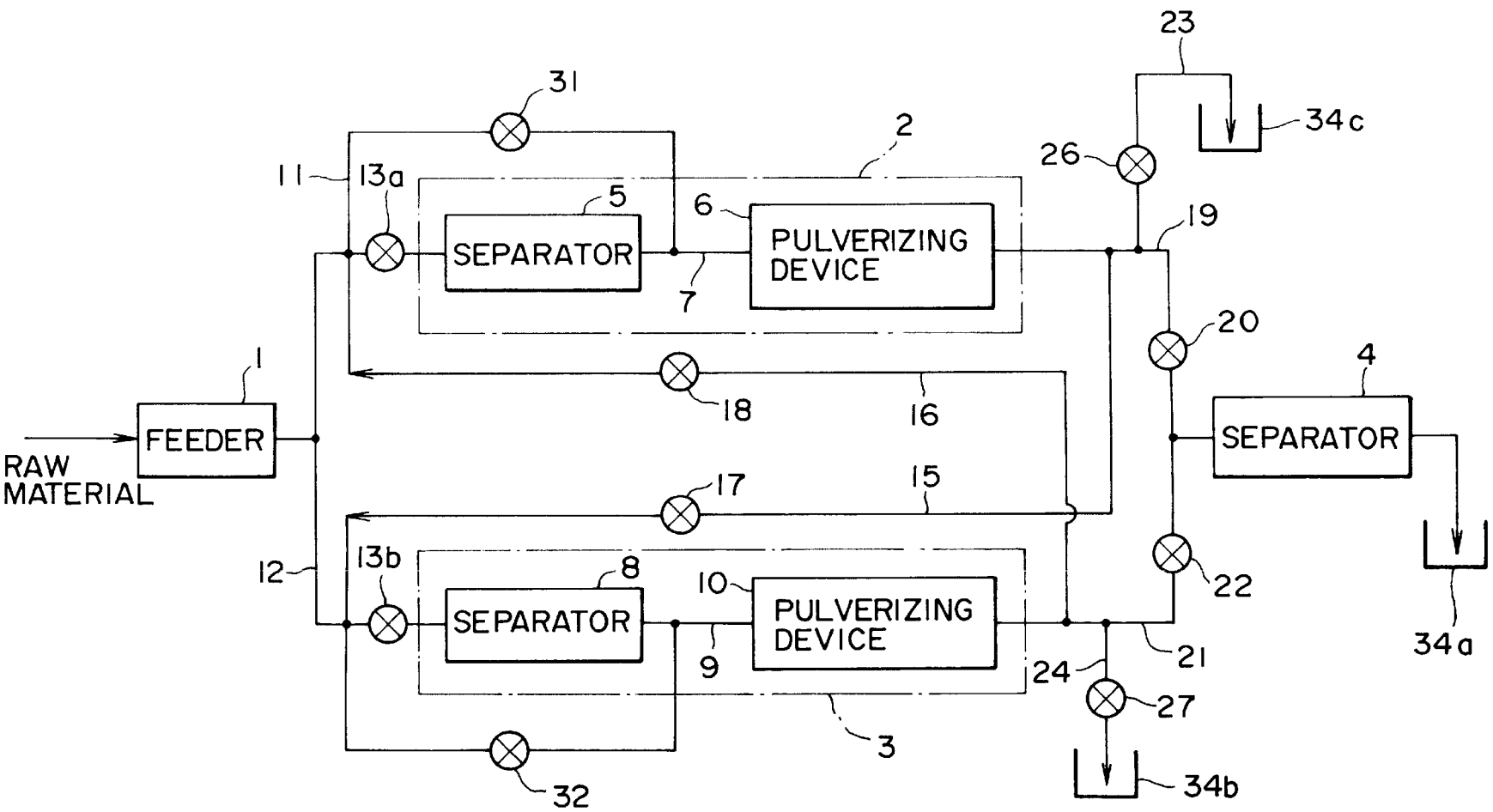
FIG. 2 is a flow diagram schematically illustrating another embodiment of the present invention.

FIG. 2 depicts another embodiment of the present invention in which the component parts similar to those in the embodiment of FIG. 1 are designated by the same reference numerals. Thus, designated generally as 2 and 3 are first and second pulverizing zones, respectively. The first pulverizing zone 2 includes a coarse particles-separator 5, an impact-type pulverizing device 6 connected to the separator 5 through a line 7, a first inlet conduit 11 connected to the separator 5 and a first outlet conduit 19 connected to the pulverizing device 6. The solid particles fed to the first pulverizing zone 2 through the first inlet conduit 11 are fed to the separator 5 to remove coarse particles therefrom. The remainder particles are pulverized by the impact-type pulverizing device 6 and then discharged from the first pulverizing zone 2 through the first outlet conduit 19.

The second pulverizing zone 3 includes a coarse particles-separator 8, a mechanical-type pulverizing device 9 connected to the separator a through a line 10, a second inlet conduit 12 connected to the separator a and a second outlet conduit 21 connected to the pulverizing device 9. Thus, the solid particles fed to the second pulverizing zone 3 through the second inlet conduit 12 are first separated in the separator 8 for the removal of coarse particles, then pulverized by the mechanical-type pulverizing device 9 and finally discharged from the second pulverizing zone 3 through the second outlet conduit 21.

Any known separator may be used as the separators 5 and 8. Illustrative of suitable separators are a centrifugal classifier, an inertia classifier, a forced vortex-type centrifugal classifier and a free vortex-type centrifugal classifier. Examples of commercially available separators include Micron Separator (manufactured by Hosokawa Micron Inc.), Microblex (manufactured by Alubine Inc.), Elbow Jet (manufactured by Nittetu Xogyo Inc.), Turbo Crusher (manufactured by Nisshin Engineering Inc.), Aqucut (manufactured by Japan Donaldson Inc.), Super Separator (manufactured by Hosokawa Micron Inc.) and Dispersion Separator (manufactured by Japan Pneumatic Inc.).

Designated as 1 is a raw material feeder connected to the first and second pulverizing zones 2 and 3 through the inlet conduits 11 and 12 and valves 13*a* and 13*b*, respectively, so that the raw material solid particles may be selectively introduced into desired one of the first and second pulverizing zones 2 and 3 by the operation of the valves 13*a* and 13*b*.

A first transferring conduit 15 extends between the first pulverizing zone 2 and the second pulverizing zone 3 for introducing the solid particles pulverized in the impact-type pulverizing device 6 into the second pulverizing zone 3. Also a second transferring conduit 16 extends between the second pulverizing zone 3 and the first pulverizing zone 2 for introducing the solid particles pulverized in the mechanical-type pulverizing device 9 into the first pulverizing zone 2. Valves 17 and 18 are disposed in the first and second transferring conduits 15 and 16, respectively.

Thus, by selectively setting the positions of the valves 13*a*, 13*b*, 17 and 18, the solid particles may be successively pulverized in the impact-type pulverizing device 6 and in the mechanical-type pulverizing device 9 in this or reverse order, In the illustrated embodiment, the outlet conduits 19 and 21 are connected to a fine particles-separator 4 through valves 20 and 22 for removing excessively fine particles contained in the pulverized product. The separator 4 may be suitably selected from those described above in connection with the coarse particles-separators 5 and 8. The pulverized product from which particles having a size finer than a predetermined diameter have been removed is recovered through a line 25 in a collecting vessel 34*a*. when such removal of fine particles is not necessary, the pulverized product can be recovered as such through a line 23 and a valve 26 in a collecting vessel 34*c* or through a line 24 and a valve 27 in a collecting vessel 34*b*. Further, when the removal of coarse particles is not necessary, the raw naterial solid particles may be fed directly to the pulverizing device 6 or 9 by using a by-path line 28 having a valve 31 or a by-path line 29 having a valve 324 The above-described valves 13, 13*a*, 13*b*, 17, 18, 20, 22, 26, 27, 31 and 32 may be any known valves such as two-way or three-way solenoid or rotary valves.

The impact-type pulverizing device 6 is suited for obtaining particles with a particle size of 10 μm or less. The pulverized product has an angular shape with sharp edges. It has been found an angular toner for use in electrophotography has a problem because of low fluidity and non-uniform charging characteristics. Parenthetically, a spherical toner produced by a polymerization method has a problem that residual toner remaining on a photosensitive recording medium after the image transfer is difficult to be removed in a succeeding cleaning step. The impact-type pulverizing device 6 has an additional problem that excessively pulverized fine particles are produced in a significant amount.

The mechanical-type pulverizing device 9, on the other hand, can improve the roundness of the pulverized product especially when the pulverization is performed to produce fine particles, since the sharp edges are rounded upon moving contact of the particles with each other. The roundness is further improved when the pulverization is carried out at an elevated temperature, since the sharp edges are also rounded by melting. However, with the mechanical-type pulverizing device 9, it is difficult to obtain a pulverized product having a particle size of 10 μm or less.

With the pulverizing apparatus according to the present invention, the order of the treatment in the impact-type and mechanical-type pulverizing devices can be selected at will so as to obtain, with a high process efficiency, a toner having desired characteristics. For example, in the embodiment of FIG. 2, by maintaining the valves 13*b*, 18, 20, 26, 27, 31 and 32 in close positions, while maintaining the valves 13*a*, 17 and 22 open, the pulverization is carried out in the first pulverizing zone 2 and then in the second pulverizing zone 3. In this case, the raw material solid particles can be effectively pulverized in the first pulverizing zone to a predetermined small particle size of, for example, (a) 10 μm, (b) 15 μm and (c) 20 μm, and the resulting angular pulverized particles can be each ground in the second pulverizing zone 3 to a desired size of, for example, 9 μm. The roundness of the toner product is the best in the case of (c), while the process efficiency is the best in the case of (a).

It is preferred that the second pulverizing zone 3 be so arranged as to prevent outside air from entering in the coarse particles-separator 8 and the pulverizing device 9 for reasons of uniformity of roundness of the toner product. It is also preferred that the pulverizing zone 3 be provided with means for controlling the temperature in the separator 8 and the pulverizing device 9.

In the embodiment of FIG. 2, by maintaining the valves 13*a*, 17, 22, 26, 27, 31 and 32, while maintaining the valves 13*b*, 18 and 20 open, the pulverization is carried out in the second pulverizing zone 3 and then in the first pulverizing zone 2. In this case, the raw material solid particles can be effectively pulverized in the second pulverizing zone to a predetermined medium particle size of, for example, 15 μm, and the resulting pulverized particles can be ground in the first pulverizing zone 2 to a desired fine size of, for example, 7 μm. Since the mechanical-type pulverizing device 9 is more efficient than the impact-type pulverizing device 6 in the pulverization to 10–500 μm, while the impact-type pulverizing device 6 is more efficient in the pulverization to 10 μm or less, high overall process efficiency is obtainable by the above operation. Moreover, the mechanical-type pulverizing device 9 can give a pulverized product having narrow particle size distribution. Therefore, the pulverization in the second pulverizing zone 3 followed by the pulverization in the first pulverizing zone 2 is effective to reduce the amount of excessively pulverized particles and, thus, to produce a toner having a narrow particle distribution with high efficiency. The fine particles-separator 4 and coarse particles-separators 5 and 8 can further narrow the particle distribution of the product.

The foregoing embodiments may be modified in various manner. For example, a feeder may be disposed in each of the transferring lines 15 and 16 for transferring a predetermined amount of the pulverized particles from the first pulverizing zone 2 to the second pulverizing zone 3 or vice versa.

The following examples will further illustrate the present invention.

EXAMPLE

Styrene-acrylate resin particles as a raw material were pulverized with the apparatus shown in FIG. 2 in which Jet-type Mill IDS-2 manufactured by Japan Pneumatic Industry Co., Ltd.) was used as the impact-type pulverizing device 6, Fine Mill FM-300S (manufactured by Japan Pneumatic Industry Co., Ltd.) was used as the mechanical-type pulverizing device 9 and Dispersion Separator DS-2 (manufactured by Japan Pneumatic Industry Co., Ltd.) was used as the fine particles-separator 4. Pulverization was carried out for five different Runs 1–5.

In Run 1, only the valves 31, 17, 32 and 27 were maintained open so that the raw material was pulverized first in Jet-type Mill and then in Fine Mill and the pulverized product was collected in the vessel 34*b*. The raw material was fed at a rate of 5 kg/hour. The pulverized product obtained in the Jet-type Mill had a volume average diameter of 10.6 μm and contained 20 i of particles having diameters of 6 μm or less. The pulverized product obtained in the Fine Mill had a volume average diameter of 9.1 μm, contained 24% of particles having diameters of 6 μm or less and was amorphous shape with rounded edges.

In Run 2, the valves 32, 18, 31 and 26 were maintained open so that the raw material was pulverized first in Fine Mill and then in Jet-type Mill and the pulverized product was collected in the vessel 34*c*. The raw material was fed at a rate of 7 kg/hour. The pulverized product obtained in the Fine Mill had a volume average diameter of 18.6 μm and contained 11% of particles having diameters of 6 μm or less. The pulverized product obtained in the Jet-typo Mill had a volume average diameter of 9.0 μm, contained 25% of particles having diameters of 6 μm or less and was amorphous shape with angular edges.

In Run 3, the valves 32, 18, 31 and 20 were maintained open so that the raw material was pulverized first in Fine Mill and then in Set-type Mill and the pulverized product was collected in the vessel 34*a*. The raw material was fed at a rate of 7 kg/hour. The pulverized product obtained in the Fine Mill had a volume average diameter of 18.6 μm and contained 11% of particles having diameters of 6 μm or less. The pulverized product obtained in the Jet-type Mill had a volume average diameter of 9.0 μm and contained 25% of particles having diameters of 6 μm or less. The pulverized product obtained in the separator 4 had a volume average diameter of 9.5 μm, contained 11% of particles having diameters of 5 μm or less and was amorphous shape with angular edges. The yield of the pulverized product with acceptable particle sizes was 92%.

In Run 4, only the valves 32 and 22 were maintained open 50 that the raw material was pulverized in Fine Mill and the pulverized product was collected in the vessel 34*a*. The raw material was fed at a rate of 2.8 kg/hour. The pulverized product obtained in the Fine Mill had a volume average diameter of 9.2 μm and contained 24% of particles having diameters of 6 μm or less. The pulverized product obtained in the separator 4 had a volume average diameter of 9.7 μm, contained 10% of particles having diameters of 5 μm or less and was spherical shape without angular edges. The yield of the pulverized product with acceptable particle sizes was 79%.

In Run 5, the valves 31 and 20 were maintained open so that the raw material was pulverized in Jet-type Mill and the pulverized product was collected in the vessel 34*a*. The raw material was fed at a rate of 4.5 kg/hour. The pulverized product obtained in the Jet-type Mill had a volume average diameter of 9.0 μm and contained 29% of particles having diameters of 6 μm or less. The pulverized product obtained in the separator 4 had a volume average diameter of 9.5 μm, contained 12% of particles having diameters of 5 μm or less and was amorphous shape without sharp edges. The yield of the pulverized product with acceptable particle sizes was 77%.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. An apparatus for pulverizing solid particles, comprising:

a feed line for delivering a raw material in the form of solid particles to be pulverized by the apparatus;

a first pulverizing zone including an impact-type pulverizing device;

first inlet conduit means connected to said first pulverizing zone for feeding said solid particles thereto, first outlet conduit means connected to said first pulverizing zone, so that said solid particles fed to said first pulverizing zone through said first inlet conduit means are pulverized by said impact-type pulverizing device and then discharged from said first pulverizing zone through said first outlet conduit means;

a second pulverizing zone including a mechanical-type pulverizing device;

second inlet conduit means connected to said second pulverizing zone for feeding said solid particles thereto;

second outlet conduit means connected to said second pulverizing zone, so that said solid particles fed to said second pulverizing zone through said second inlet conduit means are pulverized by said mechanical-type pulverizing device and then discharged from said second pulverizing zone through said second outlet conduit means;

means connected to said feed line for selectively introducing said raw material solid particles from said feed line into either one of said first and second inlet conduit means;

first transferring conduit means extending between said first pulverizing zone and said second pulverizing zone for introducing said solid particles pulverized in said impact-type pulverizing device into said second pulverizing zone;

second transferring conduit means extending between said second pulverizing zone and said first pulverizing zone for introducing said solid particles pulverized in said mechanical-type pulverizing device into said first pulverizing zone;

first means provided in said first outlet conduit means and said first transferring conduit means for selectively introducing said solid particles pulverized in said impact-type pulverizing device into either one of said first outlet conduit means and said first transferring conduit means; and second means provided in said second outlet conduit means and said second transferring conduit means for selectively introducing said solid particles pulverized in said mechanical-type pulverizing device into either one of said second outlet conduit means and said second transferring conduit means, whereby said solid particles may be successively pulverized in said impact-type pulverizing device and in said mechanical-type pulverizing device in this or reverse order.

2. An apparatus as claimed in claim 1, wherein said first pulverizing zone comprises separating means located upstream of said impact-type pulverizing device for dividing said solid particles ted to said first pulverizing zone through said first inlet conduit means into a relatively large particle size product and a relatively small particle size product so that said relatively small particle size product is pulverized by said impact-type pulverizing device.

3. An apparatus as claimed in claim 1, wherein said second pulverizing zone comprises separating means located upstream of said mechanical-type pulverizing device for dividing said solid particle fed to said second pulverizing zone through said second inlet conduit means into a relatively large particle size product and a relatively small particle size product so that said relatively small particle size product is pulverized by said mechanical-type pulverizing device.

4. An apparatus for pulverizing solid particles, comprising:

a feed line for delivering a raw material in the form of solid particles to be pulverized by the apparatus;

a first pulverizing zone including an impact-type pulverizing device;

first inlet conduit means connected to said first pulverizing zone for feeding said solid particles thereto, first outlet conduit means connected to said first pulverizing zone, so that said solid particles fed to said first pulverizing zone through said first inlet conduit means are pulverized by said impact-type pulverizing device and then discharged from said first pulverizing zone through said first outlet conduit means;

a second pulverizing zone including a mechanical-type pulverizing device;

second inlet conduit means connected to said second pulverizing zone for feeding said solid particles thereto;

second outlet conduit means connected to said second pulverizing zone, so that said solid particles fed to said second pulverizing zone through said second inlet conduit means are pulverized by said mechanical-type pulverizing device and then discharged from said second pulverizing zone through said second outlet conduit means;

means connected to said feed line for selectively introducing said raw material solid particles from said feed line into either one of said first and second inlet conduit means;

first transferring conduit means extending between said first pulverizing zone and said second pulverizing zone for introducing said solid particles pulverized in said impact-type pulverizing device into said second pulverizing zone;

second transferring conduit means extending between said second pulverizing zone and said first pulverizing zone for introducing said solid particles pulverized in said mechanical-type pulverizing device into said first pulverizing zone;

first means provided in said first outlet conduit means and said first transferring conduit means for selectively introducing said solid particles pulverized in said impact-type pulverizing device into either one of said first outlet conduit means and said first transferring conduit means; and second means provided in said second outlet conduit means and said second transferring conduit means for selectively introducing said solid particles pulverized in said mechanical-type pulverizing device into either one of said second outlet conduit means and said second transferring conduit means, whereby said solid particles may be successively pulverized in said impact-type pulverizing device and in said mechanical-type pulverizing device in this or reverse order, further comprising separating means having an inlet port selectively connected to either one of said first and second outlet means to divide a pulverized product fed from said inlet port into a relatively large particle size product and a relatively small particle size product.

* * * * *